US009500021B2

(12) United States Patent
Counas

(10) Patent No.: US 9,500,021 B2
(45) Date of Patent: Nov. 22, 2016

(54) CASE, BASE, AND BOX FOR PROTECTING JEWELS, WATCHES, AND VALUABLE OBJECTS

(76) Inventor: Pascal Daniel Counas, Nordheim (DE)

( * ) Notice: Subject to any disclaimer, the term of this patent is extended or adjusted under 35 U.S.C. 154(b) by 359 days.

(21) Appl. No.: 13/982,068

(22) PCT Filed: Feb. 2, 2012

(86) PCT No.: PCT/FR2012/050234

§ 371 (c)(1),
(2), (4) Date: Sep. 12, 2013

(87) PCT Pub. No.: WO2012/104562

PCT Pub. Date: Aug. 9, 2012

(65) Prior Publication Data

US 2014/0137777 A1 May 22, 2014

(30) Foreign Application Priority Data

Feb. 4, 2011 (FR) ..... 11 50939

(51) Int. Cl.
*A45C 11/16* (2006.01)
*E05G 1/00* (2006.01)
(Continued)

(52) U.S. Cl.
CPC ..... *E05G 1/005* (2013.01); *A45C 11/16* (2013.01); *A45C 13/18* (2013.01); *A45F 5/00* (2013.01);
(Continued)

(58) Field of Classification Search
CPC ..... A45F 5/00; A45F 5/0053; A45F 2005/008; A45F 2003/006; A45F
(Continued)

(56) References Cited

U.S. PATENT DOCUMENTS 1,542,113 A 7/1895 Schwab
1,609,481 A 12/1926 McCarthy et al.
(Continued)

FOREIGN PATENT DOCUMENTS

DE 20 2006 011 305 U1 11/2006
FR 2 729 276 A3 7/1996
FR 2 789 856 A1 8/2000

OTHER PUBLICATIONS

European Patent Office; Search Report and Written Opinion in International Patent Application No. PCT/FR2012/050234 dated Apr. 13, 2012; 11 pages.
(Continued)

*Primary Examiner* — Corey Skurdal
(74) *Attorney, Agent, or Firm* — Wood Herron & Evans LLP

(57) ABSTRACT

The invention relates to a case for protecting valuable objects provided to be carried by a living being, comprising:

a bottom portion, and a lid portion between them defining at least one compartment for receiving one or more objects to be protected, closure means of the lid portion with the bottom portion, so-called external attachment means of said case around a part of the body of a person and, said case comprising moreover, on at least one of the outer walls of the bottom portion or of the lid portion, a so-called connecting shape, provided for securely connecting or engaging said case on a base provided for this purpose.

15 Claims, 6 Drawing Sheets

(51) Int. Cl.
*A45C 13/18* (2006.01)
*A45F 5/00* (2006.01)

(52) U.S. Cl.
CPC .... *A45F 2005/002* (2013.01); *A45F 2005/008* (2013.01)

(58) Field of Classification Search
CPC ..... 2005/002;E05G 1/005; A45C 11/16; A45C 13/18
See application file for complete search history.

(56) References Cited

U.S. PATENT DOCUMENTS

| | | | | |
|---|---|---|---|---|
| 2,227,131 | A | 12/1940 | Friedman | |
| 2,553,089 | A | 5/1951 | Holder | |
| 2,582,473 | A | 1/1952 | Belfert | |
| 4,277,842 | A | 7/1981 | Richards | |
| 4,324,446 | A | 4/1982 | LeSage | |
| 6,330,961 | B1 | 12/2001 | Borja | |
| 8,596,506 | B2 * | 12/2013 | Yu | B62H 5/00 224/419 |
| 2004/0251285 | A1 | 12/2004 | O'Neill | |
| 2007/0261978 | A1 | 11/2007 | Sanderson | |
| 2010/0123375 | A1 * | 5/2010 | Romaen | E05B 65/464 312/215 |

OTHER PUBLICATIONS

French Patent Office; Search Report in French Patent Application No. 1150939 dated Sep. 9, 2011; 2 pages.

* cited by examiner

CASE, BASE, AND BOX FOR PROTECTING JEWELS, WATCHES, AND VALUABLE OBJECTS

TECHNICAL FIELD

The invention relates to a device, case, receptacle, base and box for protecting jewellery, watches and valuable objects.

The field of the invention is the field of the protection of valuable objects capable successively of being worn by a person, transported by any means of locomotion or stored in a predefined place, and more particularly the field of the protection of all valuable objects that may be carried by a living being such as jewellery, watches, rings, necklaces, credit cards, banknotes, USB sticks and vehicle keys, musical instruments, secret documents, precious objects for personal or industrial use, etc.

BACKGROUND

Currently, carrying high-value objects gives rise to a number of problems associated with protecting the quality or the price of these objects according to the location and the changing activity of the bearer.

A person moving with objects such as a wristwatch and/or jewellery is significantly exposed to his environment such as doors and door frames, walls, street furniture and obstructions in town, work, family and sporting activities, leisure pursuits, everyday household activities, mountain, beach and marine activities, etc. Watches and jewellery become worn, their quality impaired, and risk deterioration that is sometimes irreversible and always unwelcome for people who appreciate these fine objects.

People owning such high value objects like to wear them but often refrain as a result of their schedule, in which there is potential exposure to risk. Sometimes with hindsight they regret either having the objects with them, or not having them with them. Similarly, when these people travel or go away on holiday, they enjoy taking their precious objects with them. They are then often obliged to keep their valuables with them throughout their stay and to subject them to unsuitable conditions. A person on a beach either cannot bathe, or must bathe wearing his watch and jewellery or even valuables, or takes the risk of leaving his objects on the beach.

Moreover, such people sometimes fear attack when their objects are worn in full view.

Finally, the storage of objects that are not being worn, at home or away from home, often causes problems from a security point of view, both for protecting their inherent qualities and for guarding against prying eyes.

In order to provide a solution to this situation, actors in the field have proposed certain solutions, such as the watch protection devices described in the patents U.S. Pat. No. 2,227,131; U.S. Pat. No. 2,582,473; U.S. Pat. No. 4,277,842; U.S. Pat. No. 2,553,089.

However, the devices presented in these patents do not fully meet users' expectations. They relate essentially to systems for protecting watches, made from Velcro fabric, polymers or leather. They generally require the watch to be removed from the wrist, then either mounting a protection device over the case of the watch, or mounting the watch strap on a support, itself worn on the wrist. These systems are insecure, ineffective and unreliable.

A purpose of the present invention is to overcome the aforementioned drawbacks.

A further purpose of the present invention is to propose a device for protecting valuable objects that is simpler and more practical in use.

A further purpose of the present invention is to propose a device for protecting valuable objects that is more effective and more reliable than the devices of the state of the art.

SUMMARY

The invention allows at least one of the aforementioned aims to be achieved by a device for protecting valuable objects, characterized in that it comprises:

- a first portion, called the bottom portion, having a shape and dimensions capable of insertion under said valuable object when said object is worn,
- and a second portion, called a lid portion, provided to be arranged over said object,
- closure means providing a connection between said bottom and lid portions.

Thus, the device according to the invention does not require the removal of the valuable object worn. It can be arranged around the valuable object or objects to be protected. Thus, in the case for example of a watch worn on the wrist, the protection device can be put in place without the need to remove the watch. The device according to the invention is therefore simpler to use and more ergonomic that the devices of the state of the art.

Moreover, the device according to the invention allows more effective protection of the valuable object compared to the devices of the state of the art because it comprises a bottom portion and a lid portion which between them define a secure compartment for receiving the object to be protected. Thus, the object is protected from all directions and not just against impact in a single direction.

Advantageously, the device according to the invention can moreover comprise locking means of the lid portion with the bottom portion in the closed position, so that said bottom and lid portions cannot be opened even by actuating the closure means. The locking means thus make it possible to protect the valuable object against accidental opening of the closure means. They therefore contribute a redundant/additional level of security. The immobilizing means can comprise screws, nuts, lugs, grooves, pins, retainers, a snap ring or any other suitable means.

The device according to the invention can moreover comprise means, called connection means, of connecting said device with a similar device. Thus, a level of additional security is contributed to the object to be protected.

According to a particular embodiment, the connection means can comprise at least one hinge pin secured to the bottom portion, the axis of which is substantially perpendicular to the part of the body wearing the object to be protected.

Thus, the hinge pins of two similar devices can be connected together, by arranging them coaxially and by inserting a tubular element therein.

The hinge pin can be designed to be detachable and thus be used only in case of need.

In another version of the device according to the invention, the connection means can comprise at least one male or female slide fitting, secured to the bottom portion or the lid portion, and provided to cooperate with a male or female slide fitting of a similar device to connect the two devices together.

According to a particular embodiment, the connection means can be arranged on at least one side of said device, thus facilitating the connection with a similar device.

According to an advantageous version, the connection means can be detachable by the user and can be mounted according to choice on one side or on the other side of the protection device.

Advantageously, the device according to the invention can moreover comprise means of attaching said device to a part of the body of a human being or animal wearing said valuable object.

Moreover, provision can be made for the attachment means to be detachable from said device so that the user can freely choose whether to use them or not.

The attachment means can for example comprise a chain, secured to the protection device and encircling the part of the body wearing the valuable object such as for example the wrist, the neck, etc.

In a particular embodiment, the lid portion can be mounted on the bottom portion using a hinge, so as to be folded back.

In this case, the closure means can be arranged on the side opposite to the side bearing the hinge.

In another particular embodiment, the lid portion is mounted so that it can be clipped onto the bottom portion.

In another version of the device according to the invention the lid portion can be mounted on the bottom portion by a T-shaped, U-shaped or L-shaped slide fitting.

The closure means can comprise a male element secured to one of the bottom or lid portions cooperating with a female element secured to the other one of the bottom or lid portions.

In a particular embodiment, the male element is arranged securely on the lid portion and the female element is arranged securely on the bottom portion.

The device according to the invention can moreover comprise so-called redundant attachment means, provided to form a link between on the one hand said device and on the other hand another object worn or a part of the body of a living being wearing the object.

The redundant attachment means can comprise a chain for example.

A duplication of each means has been put in place so that one can substitute for another in the event of failure. Redundancy therefore exists for each of the following means:

closure means,
immobilizing/locking means,
connection means,
fixing means,
attachment means.

Redundancy is provided by screws, nuts, lugs, grooves, pins, retainers, a snap ring or any other suitable means.

These redundant attachment means allow an additional level of security against the loss or theft of the valuable object protected.

Advantageously, the lid portion and/or the bottom portion is/are at least partially transparent allowing visual contact with the protected object.

Advantageously, the lid portion and/or the bottom portion is/are made at least partially from a rigid and impact-resistant material.

In a preferred embodiment of the device according to the invention, at least a part of the device, i.e. at least a part of the bottom portion and/or of the lid portion is produced in a material or a combination of materials chosen from the following materials:

carbon fibre,
Kevlar,
carbon-Kevlar composite fibre,
titanium,
silver,
gold,
leather,
polymers, and
etc.

The lid portion and/or the bottom portion can be at least partially rigid.

In particular embodiments, the bottom portion and the lid portion have dimensions provided for protecting a watch, a ring, a pendant or any other valuable object worn on the wrist, on the finger or around the neck, on the ankle, the waist, in a backpack or in a shoulder bag.

Thus, the bottom portion and the lid portion have a shape that is substantially similar/complementary to the shape of the object or a part of the object to be protected and dimensions substantially greater than those of the object or the part of the object to be protected.

The invention also relates to an assembly comprising at least two devices according to the invention, each of the devices comprising connection means with the other device.

According to another aspect of the invention, a case is provided for protecting valuable objects intended to be worn by a living being comprising:

a bottom portion and a lid portion, between them defining at least one compartment for receiving one or more objects to be protected,
closure means of the lid portion with the bottom portion, and
so-called external attachment means of said case around a part of the body of a person.

Such a case allows a person to carry his valuable objects or several aforementioned protection devices securely with him, for example around his waist or in a backpack.

The protective case according to the invention can moreover comprise sealing means providing a seal for the compartment when the bottom and lid portions are closed. Thus, the objects present in the security case are protected against any external intrusion. The objects are secure and protected from impacts, water, sand or any other external element which could damage the objects or their operation.

In an embodiment, the sealing means can comprise one or more joints arranged on the bottom portion or on the lid portion. This joint is compressed and provides sealing when the lid portion and the bottom portion are closed against each other.

The external attachment means can comprise one or more shapes provided to be fixed on a belt or to receive a belt, a chain or a means describing a loop around a part of the body of a person such as the waist, the arm, the neck or the leg. For example, the external attachment means can comprise loops for receiving a belt.

The external attachment means can comprise a belt or a chain or equivalent means fixed onto the case detachably or not.

Advantageously, the case according to the invention can comprise so-called internal attachment means, arranged on an inner surface of the bottom portion or of the lid portion, more particularly in the receiving compartment, and provided for attaching an object arranged in said case. These means allow an additional level of security if the case is opened, for example by accident, then the objects arranged in the case attached to the inside of the case will remain in the case.

According to a particular embodiment, the closure means can comprise at least one hinge, the lid portion being mounted on the bottom portion so as to be folded back.

According to another embodiment, the closure means can comprise at least one U-shape realized on one of the bottom or lid portions into which the other one of the bottom or lid portions is slid.

More particularly, the closure means can comprise at least one U-shape produced on two opposite walls of the bottom portion into which the lid portion is slid. This lid portion is presented in the form of a plate comprising a shape complementary to said U-shape or not, for example an L-shape or T-shape.

In the event that the U-shape is provided on the bottom portion, the lid portion can be produced in two elements, called lid elements, for example in plate form, the lid elements being slid into the U-shape in the same direction and in the same way, or two opposite, ways.

The case according to the invention can moreover comprise locking means of the lid portion with the bottom portion in the closed position. These locking means contribute an additional level of security.

In a particular embodiment, the locking means can comprise at least one threaded element provided to pass through the lid portion and to be screwed into a female threaded opening arranged on the bottom portion so that tightening said threaded element tightens said lid portion onto said bottom portion.

In another particular embodiment, the locking means can comprise at least one threaded element provided to pass through the lid portion and the bottom portion and cooperate with a nut so that tightening said nut onto said threaded element tightens said lid portion onto said bottom portion.

The case according to the invention can moreover comprise so-called retention means, provided for immobilizing the locking means in the locked position. Thus, the retention means contribute an additional level of security.

In an embodiment, when the locking means comprise a threaded element as described previously, the retention means can comprise a pin inserted into an opening arranged in the threaded element, passing through an opening arranged on the bottom portion or the lid portion or not, said pin preventing the threaded element from rotating and/or becoming detached.

The case according to the invention can comprise a locking means with an anti-theft system comprising a lock and a security chain.

The case according to the invention can moreover comprise geolocation means contributing a security solution in the event that the security/protective case is lost or stolen. The geolocation means can be of a known type and operate either with a security centre or with an application installed on a computer device which can be portable or not.

In a particular embodiment, the case according to the invention can be presented in the form of a waist pack intended to be worn around the waist.

In a particular embodiment, the case according to the invention can be presented in the form of a belt buckle intended to be worn around the waist.

The protective case, with or without the valuable objects (musical instruments, secret documents, precious objects for private or industrial use), can be removed and put away on a base.

Advantageously, the case according to the invention can comprise on at least one of the outer walls of the bottom portion or of the lid portion, a so-called connecting shape, provided for securely connecting or engaging said case on abase provided for this purpose.

According to another aspect of the invention a receptacle is proposed for a case according to the invention, characterized in that it comprises a fixing device provided to cooperate with the external attachment means of said case in order to render said case securely fixed to said receptacle.

Using the receptacle according to the invention, it is therefore possible to wear the security case(s) according to the invention in a manner that is not visible from the outside and in a receptacle which can also contain other objects.

In a particular version of the receptacle according to the invention, the fixing device of the receptacle can comprise:

- a lever mounted on an axis of rotation and provided to pass through attachment means of said case,
- means of immobilizing said lever in rotation about said axis of rotation when said lever is arranged in a so-called closed position.

In a particular example, the receptacle according to the invention can comprise:

- a lower portion,
- an upper portion, secured to said lower portion, and comprising a compartment for receiving the case,
- an outer closure system with retaining means,
- a compartment receiving other objects,
- an attachment system with redundancy of attachment.

Advantageously, the lower portion can comprise buoyancy means of said receptacle in water, such as for example a buoyancy tank.

Moreover, the upper portion of the receptacle according to the invention can comprise at least one shutter that can be moved between a closed position and an open position.

According to another aspect of the invention, a base is proposed provided for receiving a case according to the invention provided with a connecting shape, said base comprising a so-called receiving shape, complementary to the connecting shape of said case and provided to cooperate with said connecting shape in order to connect said case to said base.

In a non-limitative embodiment, the receiving shape can be a male or female slide fitting provided to cooperate with a respectively female or male connecting shape provided on a security case, said security case being slid into/over said slide fitting.

The base according to the invention can moreover comprise immobilizing means of a case secured to said base.

In the event that the connecting shape is slid onto/over the receiving shape, the immobilizing means can comprise a part immobilizing the security case in translation once said security case has been slid and secured to the base.

The base according to the invention can moreover comprise means of locking the immobilizing means to said base. Thus, the locking means contribute an additional level of security to the security provided by the immobilizing means.

Advantageously, the base according to the invention can moreover comprise means for fixing said base onto the face of a wall or a box.

According to another aspect of the invention, a box/safe is proposed comprising at least one base according to the invention fixed onto one of the inner faces of the box.

BRIEF DESCRIPTION OF THE DRAWINGS

Other advantages and features of the invention will become apparent on examination of the detailed description of embodiments which are in no way limitative, and the attached drawings in which.

In the figures, the elements common to several figures keep the same reference.

DETAILED DESCRIPTION

Figure 1:
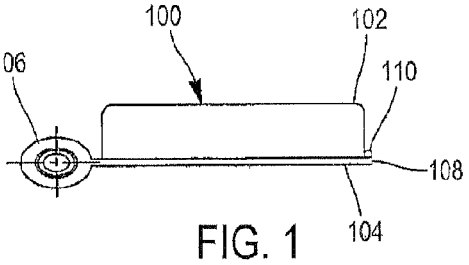
FIGS. 1 and 2 are diagrammatic representations of a first embodiment of a protection device for a watch worn on the wrist.
Figure 2:
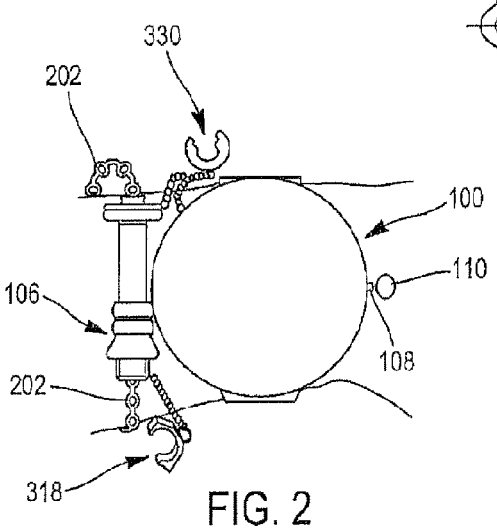

FIGS. 1 and 2 are diagrammatic representations of a first embodiment of a protection device 100 for a watch according to the invention.

The protection device 100 dedicated to the watch has the general shape of a watch case. The device 100 comprises a lid portion 102, also referred to in the remainder of the description as the "lid", and a bottom portion 104, also referred to in the remainder of the description as the "bottom". In the example shown in FIG. 1, the lid 102 is mounted by the hinge 106 on the bottom portion, so as to be folded back. The bottom 104 is produced in very thin flat sheet of the carbon-Kevlar composite fibre type and comprises an axial or radial female closure insert 108. As the bottom 104 has a very small thickness, it does not affect the comfort of wearing the watch. The bottom 104 of the protection device 100 in the open position is slipped under the case of the watch on the wrist. The lid 102 has an axial or radial male closure insert 110 cooperating with the female closure insert 108 provided on the bottom.

Figure 3:
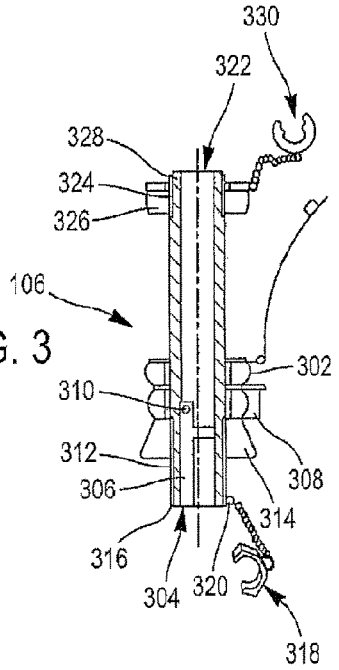
FIG. 3 is a diagrammatic representation of a hinge implemented in the device in FIGS. 1 and 2.

FIG. 3 is a detailed diagrammatic representation in cross section of an example hinge 106.

As shown in FIG. 3, the hinge 106 has a system immobilizing the lid 102 in rotation, allowing redundancy of the closure of the device 100.

To this end, the hinge 106 is composed of a fixed elongated tubular hinge pin 302, axially perforated and fixed, detachably or not, towards its centre by an insert on the bottom 104 of the device 100. The lower end 304 of the hinge pin 302 comprises an axial and radial L-shaped groove 306 on its outside diameter.

The hinge comprises a mobile part 308, fixed by insert on the lid 102 of the device 100, and which comprises a small locating spigot 310. This mobile part 308 rotates and slides on the hinge pin 302 following the groove 306 cut in the hinge pin 302. One of the ends 304 of the hinge pin 302 comprises a threaded portion 312 extending over ⅔ of said end 304. The threaded portion 312 is provided to receive a lock nut 314. The end of the thread 316 of the threaded portion 312 is hammered so that the lock nut 314 remains on the hinge pin 302. This immobilization system of the lid 102 of the device 100 is retained with a circlip on a chain 318 which is fixed on the end 304 at a point 320.

The other end 322 of the tubular hinge pin 302 is provided to receive the entire hinge of a second protection device. A portion 324 of the end 322, corresponding substantially to the last third of the hinge pin 302, is threaded and receives a lock nut 326 of the hinge of the second protection device. The end of the thread comprises a groove 328 and receives a small immobilizing circlip 330 with chain.

Moreover, as shown in FIG. 2, the tubular hinge 106 of the protection device 100 allows the passage of a chain 202 providing redundancy of attachment to the wrist, in addition to the strap of the watch.

Figure 4:
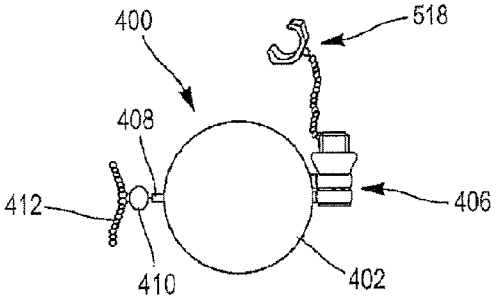
FIG. 4 is a diagrammatic representation of an embodiment of a protection device for jewellery worn on the wrist.

The protection device 400 shown in FIG. 4 dedicated to jewellery item(s) and worn on the wrist is designed according to the same principle as the protection device 100 and comprises all the elements of the protection device 100 except that the general shape of the case and of the concave bottom, suitable for the jewellery it is to contain, is less constrained. It therefore has a lid 402 and a bottom 404. The lid 402 can be folded back via a hinge 406 on the bottom 404. The bottom 404 comprises an axial or radial female closure insert 408. The lid has an axial or radial male closure insert 410. The lid 402 is folded back and locked with the closure after having deployed the immobilization system of the hinge 406. The protective case 400 can moreover comprise a chain 412 passing through the axial or radial male closure insert 410 of the lid 402 providing redundancy of attachment. The protection device 400 can moreover comprise a chain (not shown) providing redundancy of attachment to the wrist and passing through the hinge 406.

Figure 5:
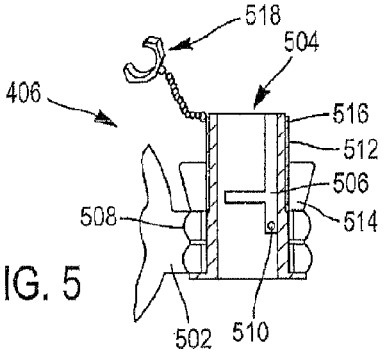
FIG. 5 is a diagrammatic representation of a hinge implemented in the device in FIG. 4.

FIG. 5 shows a representation of the hinge 406 of the device 400 in FIG. 4. The hinge 406 has a system for immobilizing the lid, allowing redundancy of the closure of the device 400. The hinge 406 is composed of an elongated tubular hinge pin 502 fixed at its lower end by an insert on the bottom 404 of the device 400. One of the ends 504 of the hinge pin 502 comprises an axial and radial L-shaped groove 506 on its outside diameter. The hinge 406 comprises moreover a mobile portion 508 fixed by insert on the lid 402 of the protection device 400, and which comprises a small locating spigot 510. This mobile portion 508 rotates and slides on the hinge pin 502 following the groove 506 cut on the hinge pin 502. The end 504 of the hinge pin 502 comprises a portion 512 which is threaded and receives a lock nut 514. The end 516 of the thread is hammered so that the nut 514 remains on the hinge pin 502. This immobilization system of the lid 502 is retained with a small circlip 518 with a chain.

Figure 6:
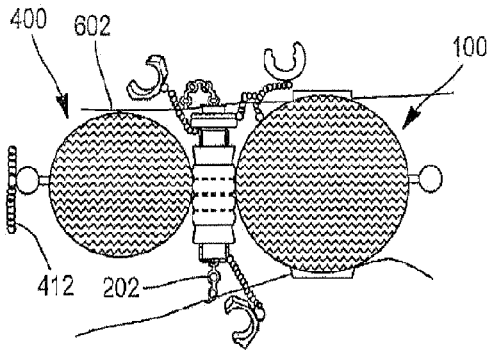
FIG. 6 is a diagrammatic representation of the assembly obtained by assembling the devices in FIGS. 1 to 5 in a configuration in which these devices are worn around a wrist.

FIG. 6 shows the assembly formed by the devices 100 and 400 in a configuration in which these devices are worn around a wrist 602 of a person.

Figure 7:
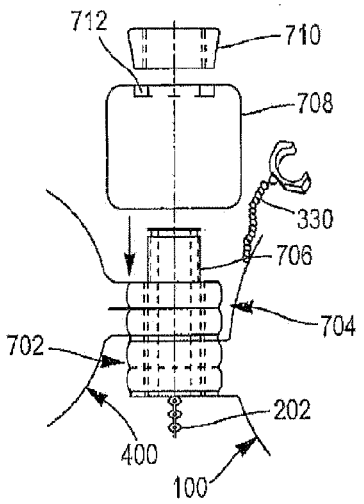
FIGS. 7 and 8 are diagrammatic representations of a simplified variant of the hinges shown in FIGS. 3 and 5.
Figure 8:
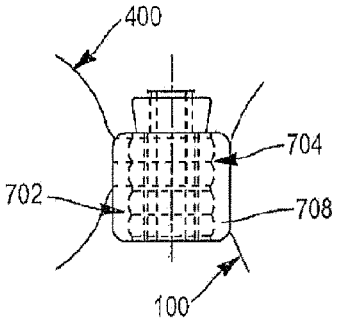

FIGS. 7 and 8 are diagrammatic representations of a variant of the hinges 106 and 406 shown in FIGS. 3 and 5.

These hinges can be used with all the protection devices according to the invention and more particularly with the devices 100 and 400 described above.

As shown in FIGS. 7 and 8, the two hinges 702 and 704 are simpler than the hinges 106 and 406.

The hinge 702 comprises an elongated tubular hinge pin fixed at one of its ends by an insert on the bottom of the protection device and comprising at the other of its ends a thread 706 provided for receiving a lock nut. The hinge 704 comprises a tubular hinge pin.

The mobile portion of each hinge is fixed by an insert on the lid of the corresponding protection device. The upper portion of the hinge 702 of the case 100 receives the hinge 704 of the protective case 400 which fits over the hinge 702 as shown in FIGS. 7 and 8. An immobilization piece 708 composed of two half-shells is inserted around the assembly formed by the hinges 702 and 704. These two half-shells provide redundancy of closure of each case. The thread 706 receives a lock nut 710. The immobilization piece 708 comprises a tube 712 which is adjusted over the span of the hinge pin of the hinge 702, the two ends of the shell immobilizing the two lids of the protection devices 100 and 400 on one side and on the other side. The lock nut 710 is retained with the circlips 330 with a chain. The hinge 702 also allows the passage of the chain 202 providing redundancy of attachment to the wrist, in addition to the wrist strap of the watch or of the jewellery item.

Figure 9:
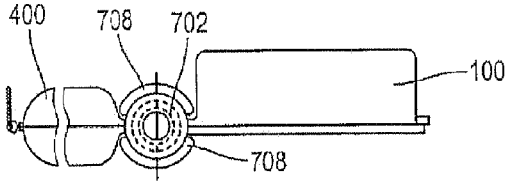
FIGS. 9 and 10 are diagrammatic representations of the assembly obtained with the hinges in FIGS. 7 and 8.
Figure 10:
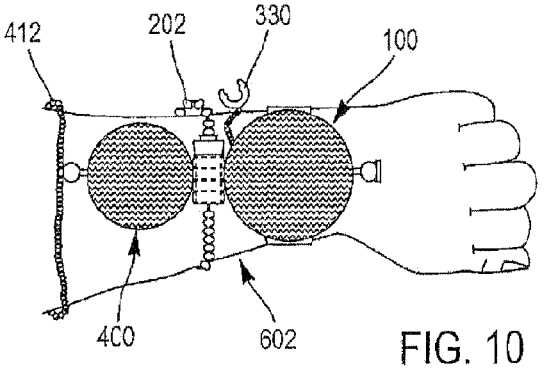

FIG. 9 is a diagrammatic representation of the assembly obtained with the hinges in FIGS. 7 and 8 and FIG. 10 is a diagrammatic representation of this assembly in the configuration in which the protection devices are worn around the wrist 602.

Figure 11:
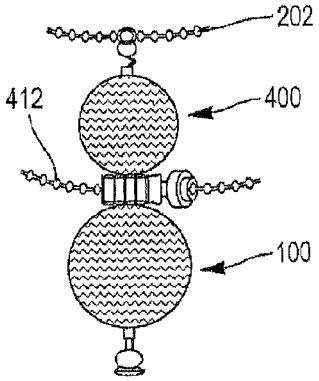
FIG. 11 is a diagrammatic representation of the devices 100 and 400 in a configuration in which they are worn around the neck.

The devices 100 and 400 can also be used for protecting valuable objects worn around the neck. FIG. 11 gives a diagrammatic representation of such a configuration. In the configuration in FIG. 11, the devices 100 and 400 are unchanged. Only the length of the chains 202 and 412 is increased.

In fact, the length of these two chains can be altered for wearing around the wrist, the neck, the ankle or the waist.

Figure 12:
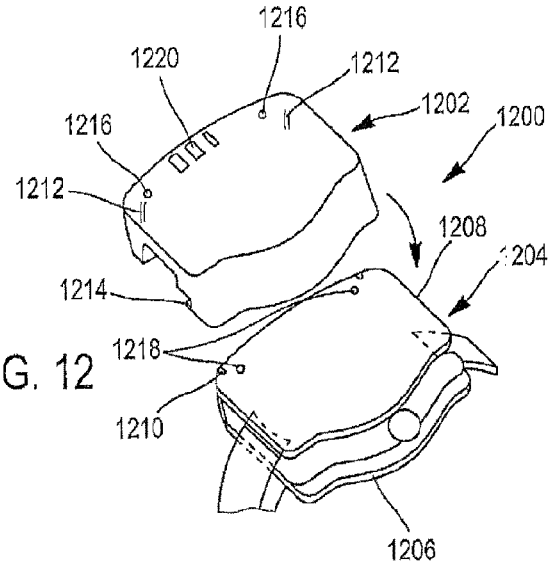
FIG. 12 is a diagrammatic representation of a variant of a protection device according to the invention for a watch.

FIG. 12 is a diagrammatic representation of a protection device 1200 according to the invention.

The device 1200 shown in FIG. 12 comprises a lid 1202, a bottom 1204.

In this version the protection device 1200 does not have a hinge. The bottom 1204 is U-shaped. One of the arms of the U, the arm 1206, is slipped under the watch or the jewellery item between the wrist and the case of the watch or jewellery item. The other arm of the U, the arm 1208, covers the top of the watch or the jewellery item, and optionally one of the sides and part of the lug ends of the watch or the jewellery case.

The U-shaped bottom 1204 is covered by the lid 1202. This lid 1202 is guided onto the bottom by female grooves 1210 situated on the left- and right-hand sides of the bottom 1204. The lid 1202 comprises male grooves 1212 cooperating with the female grooves 1210 to guide the lid 1202 onto the bottom 1204. The lid 1202 is immobilized in vertical translation with a safety guard 1214 provided on the bottom 1204. The lower faces of the lid 1202 come into abutment against the bottom 1204 at the level of the wrist strap and the lug ends of the watch or jewellery case. Immobilization is secured with 2 immobilization screw fasteners (not shown) passing through the lid via openings 1216 situated on the left-hand side of the lid 1202 and screwed into threads 1218 provided on the bottom 1204.

The device 1200 also comprises a threaded tubular hinge pin 1220 making it possible to assemble the protection device 1200 with another protection device, for example one of the protection devices 100 and 400 described above.

The tubular hinge pin 1220 also allows a security chain to be received. Assembly of the protection device 1200 with another protection device can be carried out according to the embodiments described above and implemented by the protection devices 100 and 400.

Figure 13:
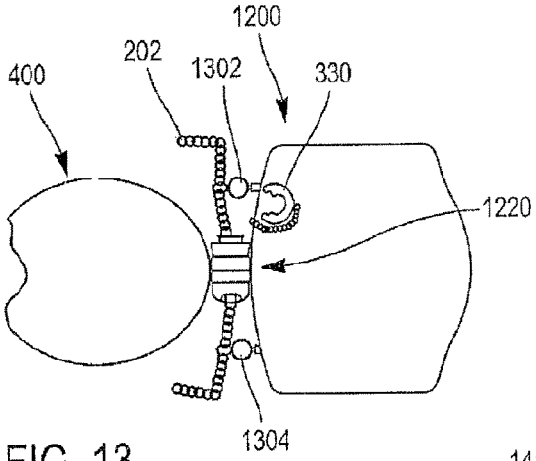
FIG. 13 is a diagrammatic representation of the assembly obtained by assembling the device in FIG. 12 with the device in FIG. 4.

FIG. 13 is a diagrammatic representation of an assembly comprising the protection device 1200 and another protection device, for example the protection device 400 in FIG. 4. In FIG. 13, two lock screws 1302 and 1304 can be seen, provided to be screwed into the threads 1218 through the openings 1216.

Figure 14:
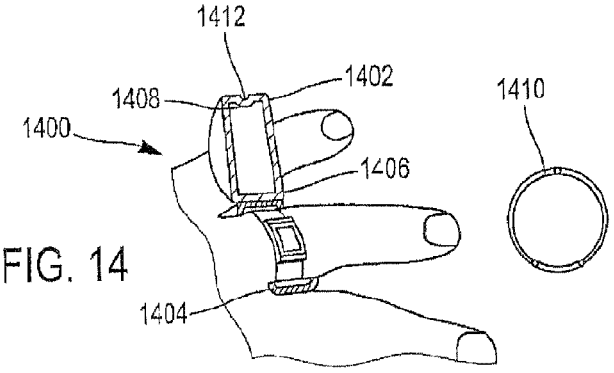
FIG. 14 is a diagrammatic representation of a variant of a protection device according to the invention for a ring worn on the finger.

FIG. 14 is a diagrammatic representation of a variant of a protection device 1400 according to the invention for a ring worn on the finger.

In the embodiment, the protection device 1400 for a ring kept on the finger comprises a lid 1402, a bottom 1404, the lid 1402 being mounted on the bottom 1404 by a hinge 1406. The lid comprises a projecting form 1408 for carrying out the closure of the lid 1402 onto the bottom 1404 by exerting a pressure tightening the lid 1402 onto the bottom 1404.

The device comprises moreover means for immobilizing the closure of the lid 1402 on the bottom 1404 which comprise a snap ring 1410 provided to be arranged on the circumference of the device 1400 in a groove 1412 produced on the circumference of the device 1400.

The protection devices and the hinges described herein can be combined with each other without limitation. Although the examples described are limited to the assembly of two protection devices it is possible to assemble several protection devices combined with any one of the hinges or hinge pins described.

The inside of each of the protection devices is padded and can be covered with leather and/or synthetic foam in order to provide a soft surface for the contained objects.

Figure 15:
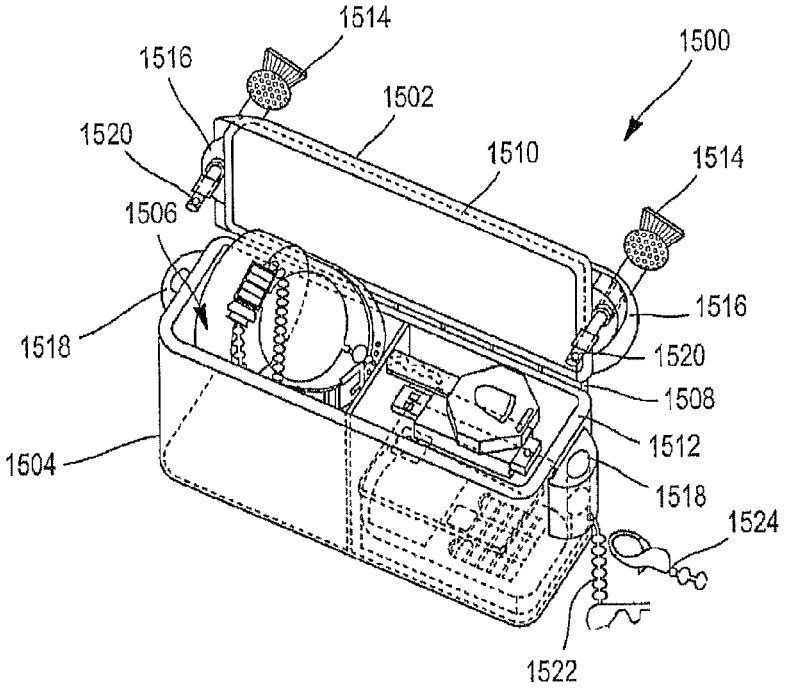
FIGS. 15 and 16 are diagrammatic representations of two examples of a protective case according to the invention.

FIG. 15 is a diagrammatic representation of a first example of a protective case according to the invention.

The case 1500 represented in FIG. 15 is presented in the form of a belt pouch comprising a bottom portion 1504, also called bottom in the remainder of the description, a lid portion 1502, also called lid in the remainder of the description. The bottom 1504 and the lid 1502 between them form a compartment 1506 for receiving one or more protection devices 100, 400, 1200 and other valuable objects such as credit cards, banknotes, USB sticks and vehicle keys. The compartment 1506 can be divided into several subcompartments.

The lid 1502 and the bottom 1504 are held by a hinge 1508. The lid 1502 and the bottom 1504 comprise a joint plane 1510 and 1512 constituted by 2 faces with offset centres and equipped with "O" ring seals that seal by compression.

The compression and immobilization of the lid 1502 when closed on the bottom 1504 are ensured by two screw fasteners 1514 placed laterally on two bosses 1516 situated on the lid 1502. The bottom 1504 comprises two threaded centring bosses 1518, facing bosses 1516 of the lid 1502, to receive the two screw fasteners 1514.

Each of the two screw fasteners 1514 is pierced at its end and comprises an opening 1520 to receive a pin 1522 or a chain 1524 for redundancy of attachment, provided to be attached around the waist of the wearer, if redundancy of attachment is desired. The screw fastener 1514 protrudes beyond the end of the boss 1518 allowing the opening 1520 to receive the pin 1522 or the redundancy chain 1524.

Figure 16:
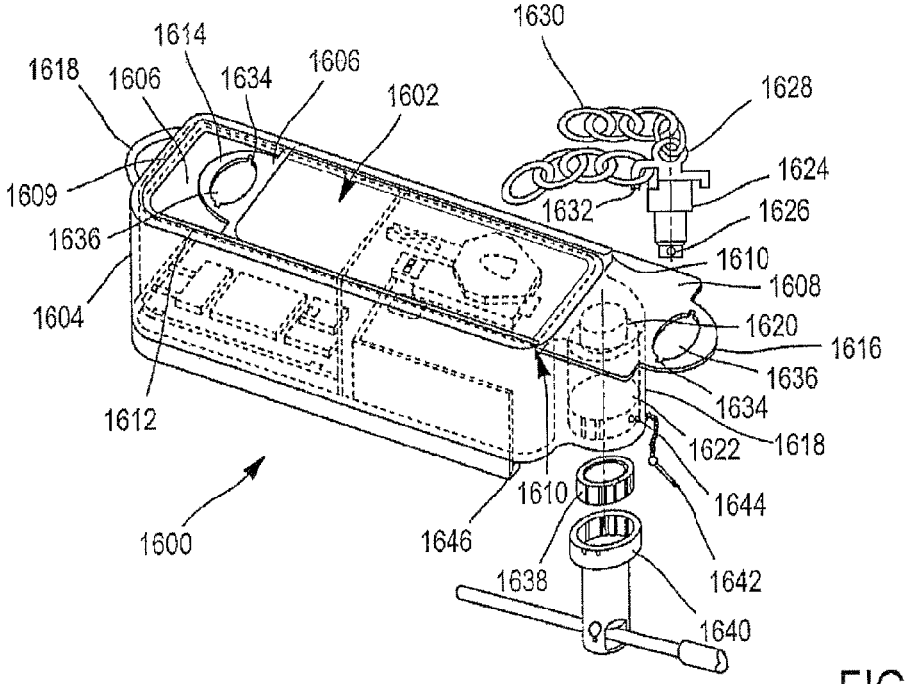

FIG. 16 is a diagrammatic representation of a second example of a protective case according to the invention.

The protective case 1600 shown in FIG. 16 is also presented in the form of a high-security watertight and fire-resistive belt pouch. It comprises a bottom 1604 and a lid 1602 comprising two substantially flat elements 1606 and 1608.

The bottom 1604 comprises on the upper portion two opposite faces and a U-shaped lateral face 1610 acting as a female slide fitting, a joint plane 1612 (not shown) comprising at least one "O" ring rendered watertight by compression. The lateral face of the U-shape comprises a slot 1609 called an aperture to allow the eye 1614 of the first element 1606 to pass through.

The case is closed by the first element 1606 engaged in the slide fitting 1610 on one side of the joint plane 1612. This first element 1606 comprises an eye 1614 which is positioned abutting the slide fitting 1610, passing through the aperture 1609. Compression of the "O" ring is carried out by the second element 1608 positioned abutting the slide fitting above the first element 1606 in the same direction. The second element 1608 also comprises an eye 1616, located on the opposite side to the eye 1614 of the first element 1606.

The bottom 1604 comprises at each of two opposite ends two centring bosses 1618 having two bore diameters 1620 and 1622, each of the bosses being provided to receive a security pin 1624. The security pins 1624 are threaded and bored radially in order to obtain an opening 1626. One of the pins 1624 comprises a small ring 1628 at the end acting as the first link of the chain of a security chain 1630. The other end of the security chain is passed around the waist of the person wearing the case 1600 and is slipped under a hook 1632 of the pin 1624. Each pin 1624 is positioned on notches 1634 formed on the edges of an opening 1636 provided on each of the eyes 1614 and 1616 of the lid elements 1606 and 1608.

A nut 1638 with a security pattern is screwed onto each security pin 1624 using an anti-theft key 1640 that has a security pattern and torque lever. The anti-theft key 1640 comprises an inner and an outer pattern. Each nut 1638 is immobilized, at the appropriate torque, at the bottom of the bore of the boss 1618, in the plane of the first bore diameter 1622. This first bore diameter 1622 comprises a female pattern over the first third of its length. Each nut 1638 is retained in rotation by a security pin 1642 chained onto the boss 1618 and inserted into each boss 1618 as far as the nut 1638 through a hole 1644 made in each boss 1618.

The security chain 1630 fixed onto the security pin 1624 provides the redundancy around the waist and the anti-theft security.

The bottom 1604 comprises on the lower portion of two opposite faces a U-shape 1646 acting as a female slide fitting allowing the case to be connected to a secure base which will be described hereinafter.

Although it has a distinct advantage in a marine environment, the anti-theft nut 1638 and key 1640 with multiple patterns can be replaced by a high security turning-barrel lock of the polished stainless steel type.

The inside of the body of the case is padded and the outside of the body is covered.

Each security case 1500 and 1600 can comprise an alarm and GPS location system incorporated into the device in a dedicated technical compartment with inspection cover. The compartment contains a rechargeable battery, a plug and charger, charge-storage diode, a GPS antenna-receiver and an emergency network alarm with activation system.

Two types of housings can be provided, allowing the arrangement on the one hand of the protection devices for watch and jewellery items and on the other hand valuable objects such as USB sticks and vehicle keys, means of payment, a phone, etc.

Figure 17:
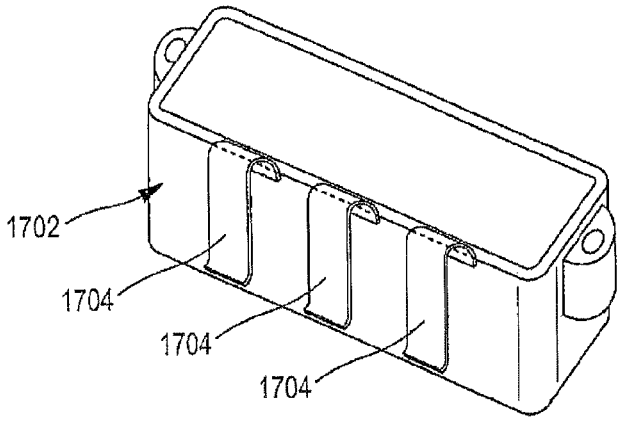
FIG. 17 is a diagrammatic representation of an example of the rear face of a protective case according to the invention, for example the protective cases in FIGS. 15 and 16.

FIG. 17 shows a rear face 1702 of a protective case which can be the rear face of the protective case 1500 or 1600.

The rear face 1702 of the bottom of the protective case comprises loops 1704 intended to be fixed on a belt or on a receptacle of the sporran type which will be described hereinafter.

Whether or not presented in the form of a belt pouch, the protective case with or without the protection devices 100, 400, 1200 and other valuables (USB stick, vehicle key, credit cards, banknotes) can be removed and put away on a base or in a receptacle of the sporran type with or without the chains.

The protective case, with or without the valuables (musical instruments, secret documents, precious objects for private or industrial use), can be removed and put away on a base.

An example of a connecting base according to the invention will now be described with reference to FIG. 18.

Figure 18:
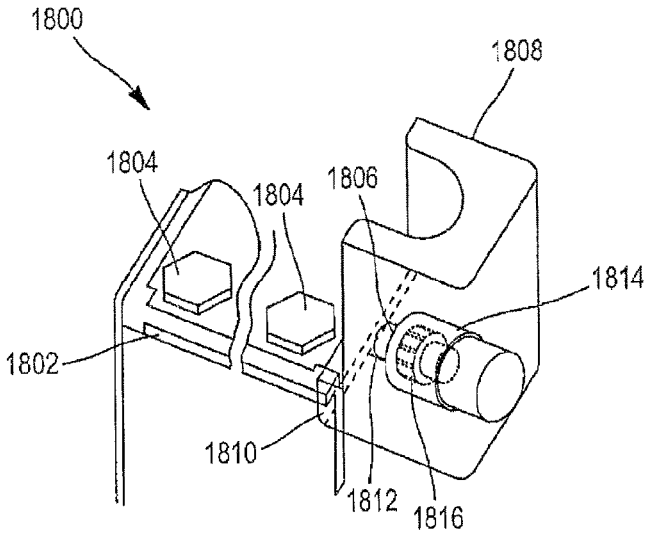
FIG. 18 is a diagrammatic representation of a base according to the invention.

FIG. 18 is a diagrammatic representation of an example base according to the invention, on which a protective case according to the invention can be secured.

The base 1800 comprises a closed male slide fitting 1802 on only one of the ends of the base 1800. This base 1800 is raised up and can be fixed by two screw fasteners 1804 onto a wall, a concrete floor, a partition of a strong box, a vehicle partition, etc.

On the side of the open end, the base comprises a threaded fixing pin 1806.

The high security protective case 1500 or 1600 is secured to the base and immobilized in translation with an L-shaped immobilization piece 1808. This immobilization piece 1808 is constituted by a safety guard, a female slide fitting 1810 and two concentric bores 1812 and 1814. A patterned security nut 1816, which can be the nut 1638, is screwed onto the security pin 1806 using a patterned key which can be the patterned key 1640 with torque lever. The nut 1816 is immobilized, at the appropriate torque, at the bottom of the bore of the immobilization piece 1808, in the plane of the first bore diameter 1814 which comprises a female pattern over the first third of its length.

The base 1800 can be a standardized model capable of equipping multiple private places (safes in hotel rooms and residences, walls and floors of buildings, vehicle partitions, desks, etc.) or public places (universities, hospitals, various infrastructures, etc.) and thus acting as a secure fixed terminal.

An example of a receptacle according to the invention presented in the form of a sporran will now be described with reference to FIG. 19.

Figure 19:
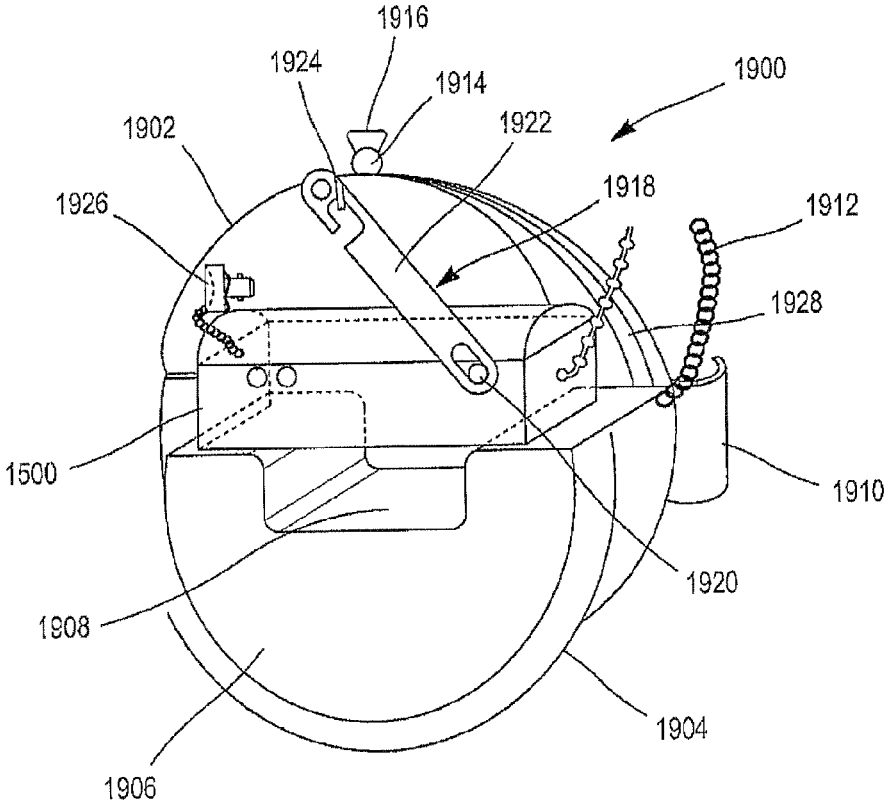
FIG. 19 is a diagrammatic representation of a receptacle according to the invention presented in the form of a sporran.

FIG. 19 is a diagrammatic representation of a receptacle 1900 according to the invention presented in the form of a sporran.

The sporran 1900 comprises a lower portion 1904 and an upper portion 1902. The lower portion 1904 is composed of a buoyancy tank 1906, a housing 1908 reserved for objects that are not affected by immersion in water or for a box or bag, watertight or not, receiving these objects.

In certain embodiments, a redundancy belt 1910 complements this lower portion.

The upper portion 1902 is composed of an attachment chain 1912 allowing the sporran 1900 to be worn. It comprises an outer closure system 1914 retained by a security pin, circlips or pressure 1916.

Opening the sporran 1900 is provided following the different bag opening methods, via a flap, a hinge and/or a zipper, etc.

The system 1918 for fastening a protective case, such as for example the protective case 1500 shown in FIG. 15, onto the sporran comprises a rotation shaft 1920 on which is fixed a lever 1922. The protective case with its fixing loops 1704 (see FIG. 17) is placed on the lever 1922 which is then immobilized in rotation with the closure system 1924 which comprises a locking device 1926.

Attaching the sporran 1900 is carried out with the chain 1912, the redundancy system is provided either by a belt 1910, or by the redundancy system used for the case 1500 capable of being deployed inside.

The relative watertightness of the sporran is implemented by thick joints 1928 allowing the passage of chains.

The assembly of the protective devices, cases and receptacle constitutes a set. The set is particularly intended for any active person owning valuable objects and experiencing the many problems associated with protecting the quality and the price of these objects in any hostile environment, according to the locations and change of activity of the person wearing or carrying them.

Any element constituting the set can be used as such for any other type of objects, material goods and/or software, private, professional or industrial, for protection from any hostile environment.

In particular, the protective case, in an advantageous version called a high-security case, can be used as an all-purpose container, and finds applications of a private nature such as portable strong-box, wallet, jewellery box, etc., sporting and/or professional use, for jewellers, diamond workers, business people, musicians, etc. The secure base, of a standardized model, can be capable of equipping multiple private places (safes in hotel rooms and residences, walls and floors of buildings, vehicle partitions, desks, etc.) or public places and thus act as a secure fixed terminal.

The protective case with or without the valuables (credit cards, banknotes, USB and vehicle keys, musical instruments, secret documents, precious objects for private or industrial use) can be removed and put away on a base.

The elements constituting the device, protective case, receptacle, base or box according to the invention can be varied and preferably made from materials having superior characteristics in terms of mechanical strength with low weight, such as carbon-Kevlar or carbon composite fibres, titanium, silver, gold, leather, etc.

Carbon-Kevlar fibre, whether hybrid, matt, gloss, iridescent blue, red, yellow, green, possibly with inlaid precious metals and minerals, apart from its aesthetic qualities and its personalization facility, has exceptional strength qualities allowing reduced bulk and weight.

Complete personalization of the set is possible.

The present invention allows modular protection intended for the valuable objects carried by a person and fitting together in a nested manner. According to the protection requirements, a watch worn on the wrist or not as well as jewellery items are rapidly put away and effectively protected by the protection devices. These protection devices fit together with the other valuable objects into the protective case and the latter is stored on the base or in the buoyant sporran type receptacle in which other personal effects can be kept.

The invention allows the user to decide on the required level of protection for his valuable objects by offering successive and redundant levels of protection.

Of course, the invention is not limited to the examples which have just been described, and numerous adjustments can be made to these examples without exceeding the scope of the invention.

The invention claimed is:

1. A system for protecting valuable objects comprising:

a case provided to be carried by a living being and receivable on a base, said case comprising:

a bottom portion and a lid portion, between them defining at least one compartment for receiving one or more objects to be protected, a closure structure configured to close said lid portion with said bottom portion in a closed position, a connecting shape located on at least one outer wall of said bottom portion or of said lid portion, provided for securely connecting or engaging said case on said base, and an external attachment structure located on said case and configured to attach said case around a part of the body of a person, wherein said external attachment structure comprises one or more forms provided for fixing onto another receptacle case, on a belt or receiving a belt, a chain or a means able to loop around the part of the body of a person such as the waist, the arm, the neck or the leg, said base provided for receiving said case, said base comprising:

a receiving shape complementary to said connecting shape of said case, and provided to cooperate with said connecting shape in order to connect said case to said base, an immobilizing structure configured to immobilize said case with respect to said base when said connecting shape of said case cooperates with said receiving shape of said base, a first locking structure for locking said case onto said base when said case is immobilized to said base, said first locking structure comprising an anti-theft system with a key lock, an anti-theft nut, a patterned safety nut, or a safety chain, and a second locking structure for locking said lid portion with said bottom portion in said closed position, said second locking structure including at least one of an anti-theft system with a key/security lock, an anti-theft nut, and/or a security chain.

2. The system according to claim 1, wherein said receiving shape is a male or female slide fitting provided to cooperate with a respectively female or male connecting shape provided on said case, said case being slid into or over said male or female slide fitting.

3. The system according to claim 2, wherein said immobilizing structure includes an immobilization piece for immobilizing in translation said case relative to said base once said case has been slipped onto or over said male or female slide fitting and connected to said base.

4. The system according to claim 1, further comprising a fastening structure for fixing said base onto at least one of a wall, a floor, a partition of a safe, or a vehicle partition.

5. A box comprising at least one system according to claim 1, said base being fixed onto an inner wall of said box.

6. A receptacle comprising at least one system according to claim 1 fixed onto an inner wall or an outer wall of said receptacle.

7. The system according to claim 1, wherein said connecting shape is arranged on a single outer wall of said bottom portion or of said lid portion.

8. The system according to claim 1, wherein said case further comprises a seal for sealing said compartment when said bottom and lid portions are closed.

9. The system according to claim 1, wherein said case further comprises an internal attachment structure, arranged on an inner surface of said bottom portion or of said lid portion, more particularly in said compartment, and provided for attaching objects (valuables or protection devices) arranged in said case.

10. The system according to claim 1, wherein said second locking structure comprises:

at least one threaded element provided to pass through said lid portion and to be screwed into a female threaded opening arranged in said bottom portion so that tightening said threaded element tightens said lid portion on said bottom, and/or at least one threaded element provided to pass through said lid portion and said bottom portion, and cooperate with a nut so that tightening said nut on said threaded element tightens said lid portion on said bottom portion and/or, an anti-theft system with a lock, an anti-theft nut or security chain.

11. The system according to claim 1, wherein said first locking structure is identical to said second locking structure.

12. The system according to claim 1, wherein said case further comprises a retention structure, provided for immobilizing said second locking structure in a locked position.

13. The system according to claim 1, wherein said case further comprises a geolocation device and/or a buoyancy device.

14. The system according to claim 1, wherein said case is one of:

a belt pouch intended to be worn around the waist, a belt buckle intended to be worn around the waist, or a backpack.

15. The system according to claim 1, further comprising a fixing device provided to cooperate with said external attachment structure in order to render said case securely fixed to a receptacle.

* * * * *